US006639195B2

(12) United States Patent
Abe et al.

(10) Patent No.: US 6,639,195 B2
(45) Date of Patent: Oct. 28, 2003

(54) IMAGE HEATING APPARATUS USING INDUCTION HEATING METHOD

(75) Inventors: Atsuyoshi Abe, Shizuoka (JP); Toshiaki Miyashiro, Shizuoka (JP)

(73) Assignee: Canon Kabushiki Kaisha, Tokyo (JP)

( * ) Notice: Subject to any disclaimer, the term of this patent is extended or adjusted under 35 U.S.C. 154(b) by 142 days.

(21) Appl. No.: 09/922,840

(22) Filed: Aug. 7, 2001

(65) Prior Publication Data

US 2002/0023920 A1 Feb. 28, 2002

(30) Foreign Application Priority Data

Aug. 8, 2000 (JP) ..... 2000-239521

(51) Int. Cl.[7] ..... H05B 6/14; H05B 6/06; G03G 15/20

(52) U.S. Cl. ..... 219/619; 219/667; 399/328

(58) Field of Search ..... 219/619, 661, 219/665, 667; 399/328, 330, 69, 331, 335, 336, 338

(56) References Cited

U.S. PATENT DOCUMENTS

| | | | | |
|---|---|---|---|---|
| 5,534,987 A | | 7/1996 | Ohtsuka et al. | 355/285 |
| 5,543,904 A | | 8/1996 | Kato et al. | 355/285 |
| 5,552,582 A | | 9/1996 | Abe et al. | 219/619 |
| 5,552,874 A | | 9/1996 | Ohtsuka et al. | 355/285 |
| 5,819,150 A | | 10/1998 | Hayasaki et al. | 399/330 |
| 5,881,349 A | | 3/1999 | Nanataki et al. | 399/328 |
| 5,911,094 A | * | 6/1999 | Tsujimoto | 399/330 |
| 5,940,655 A | | 8/1999 | Sano et al. | 399/69 |
| 5,966,577 A | | 10/1999 | Abe | 399/320 |
| 5,970,299 A | | 10/1999 | Sano et al. | 399/330 |
| 6,031,215 A | | 2/2000 | Nanataki et al. | 219/619 |
| 6,037,576 A | * | 3/2000 | Okabayashi et al. | 219/619 |
| 6,072,964 A | | 6/2000 | Abe et al. | 399/69 |
| 6,078,780 A | | 6/2000 | Abe et al. | 399/328 |
| 6,255,633 B1 | * | 7/2001 | Takagi et al. | 219/619 |

FOREIGN PATENT DOCUMENTS

| | | | |
|---|---|---|---|
| JP | 58-173773 | * 10/1983 | 399/331 |
| JP | 5-204277 | * 8/1993 | 399/331 |
| JP | 10-171296 | 6/1998 | |

* cited by examiner

*Primary Examiner*—Philip H. Leung
(74) *Attorney, Agent, or Firm*—Fitzpatrick, Cella, Harper & Scinto

(57) ABSTRACT

An image heating apparatus for heating an image formed on a recording material, including a rotation member; an excitation coil for generating a magnetic field to induce an eddy current in the rotation member; a temperature detecting element for detecting a temperature of the rotation member; and a controller for controlling an electrical supply to the excitation coil so that the temperature detected by the temperature detecting element is maintained at a set temperature, wherein while the set temperature is set a stand-by temperature, the controller controls the electrical supply to the excitation coil and the rotation member is maintained in a stoppage of rotation.

20 Claims, 9 Drawing Sheets

IMAGE HEATING APPARATUS USING INDUCTION HEATING METHOD

BACKGROUND OF THE INVENTION

1. Field of the Invention

The present invention relates to an image heating apparatus effectively used as a fixing device in an image forming apparatus such as a copier or printer. In particular, the present invention relates to an image heating apparatus of an induction heating type.

2. Description of the Related Art

The following describes by way of example a heating apparatus (image heat-fixing apparatus) for fixing an unfixed toner image formed on a recording material in an image forming apparatus such as an electrophotographic apparatus or electrostatic recording apparatus. Conventionally, contact heating systems such as hot roller and film heating types have been widely used in heating apparatuses for fixing unfixed toner images. A heating apparatus using an electromagnetic induction system as its heating source is proposed lately.

A heating apparatus for an unfixed full-color image might be required to superimpose toner layers on top of one another up to a four-ply layer. Since the unfixed full-color image needs to be heated sufficiently into the interface surface between a recording material and the toner layers so as to prevent occurrence of a fixing failure, the overlapped toner layers must be held firmly until all the toner layers are fixed.

A control method for the electromagnetic induction type heating apparatus is proposed in Japanese Patent Laid-Open Application No. 10-171296. The publication proposes that preliminary rotation and preliminary heating of a fixing film be performed during the time the apparatus is on standby in such a structure that the fixing film of small heat capacity as an electromagnetic induction heating type rotary body itself locally generates heat, thereby reducing first printing time (FPT).

Such a control method as to perform preliminary rotation and preliminary heating of the fixing film during the time the apparatus is on standby, however, increases the number of rotations of the fixing film in a case where the printer is infrequently used and hence its standby state lasts a long time. As a result, the rotating ratio of the fixing film during a standby period to the endurance of the heating apparatus becomes high to reduce the number of printable sheets.

SUMMARY OF THE INVENTION

The present invention has been made in consideration of the above-mentioned conventional problems, and it is an object thereof to provide an image heating apparatus capable of preventing occurrence of a fixing failure.

It is another object of the present invention to provide a long-lifespan image heating apparatus.

It is still another object of the present invention to provide an image heating apparatus comprising:

a rotation member;

an excitation coil for generating a magnetic field to induce an eddy current in the rotation member;

a temperature detecting element for detecting a temperature of the rotation member; and control means for controlling an electrical supply to the excitation coil so that the temperature detected by the temperature detecting element is maintained at a set temperature, wherein while the set temperature is set to a standby temperature, the control means controls the electrical supply to the excitation coil and the rotation member is maintained in a stoppage of rotation.

It is yet another object of the present invention to provide an image heating apparatus comprising:

a heating member;

an excitation coil for generating a magnetic field to induce an eddy current in the heating member;

a temperature detecting element for detecting a temperature of the heating member; and control means for controlling an electrical supply to the excitation coil so that the temperature detected by the temperature detecting element is maintained at a set temperature, wherein the control means sets the set temperature in accordance with a temperature of the excitation coil during a standby period.

It is yet another object of the present invention to provide an image heating apparatus comprising:

a heating member;

an excitation coil for generating a magnetic field to induce an eddy current in the heating member;

a temperature detecting element for detecting a temperature of the heating member; and control means for controlling an electrical supply to the excitation coil so that the temperature detected by the temperature detecting element is maintained at a set temperature, wherein the control means sets the set temperature to a first set temperature when a temperature of the excitation coil is a first temperature, and sets the set temperature to a second temperature lower than the first set temperature when the temperature of the excitation coil is a second temperature higher than the first temperature during a standby period.

Further and other objects of the present invention will become apparent from reading the following detailed description in connection with the accompanying drawings.

DESCRIPTION OF THE PREFERRED EMBODIMENTS

First Embodiment (1) Example of Image Forming Apparatus

Figure 1:
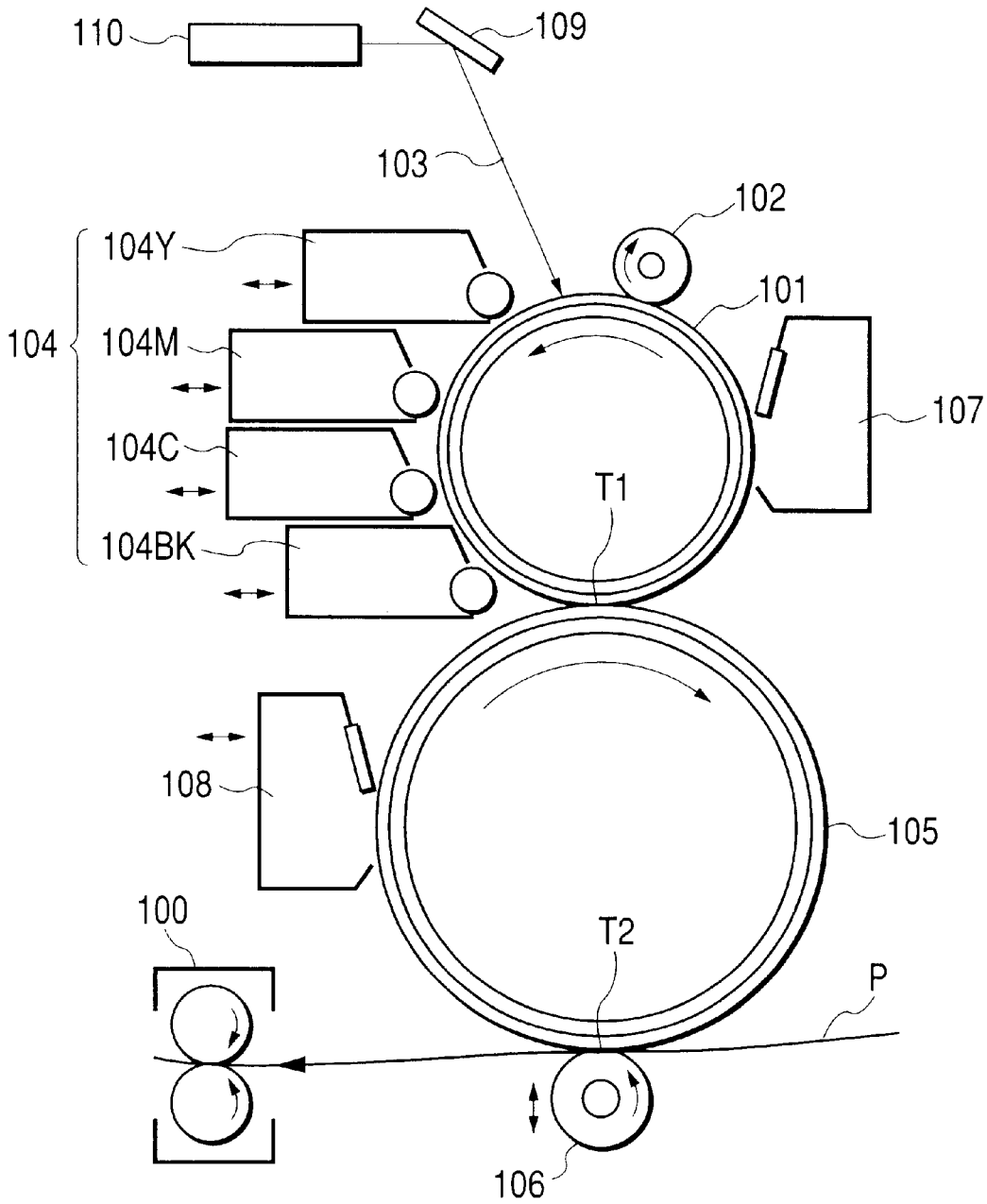
FIG. 1 is a schematic sectional view of an image forming apparatus using an image heating apparatus according to the present invention.

FIG. 1 is a schematic sectional view illustrating an exemplary structure of an image forming apparatus. The image forming apparatus of this example is an electrophotographic color printer.

The reference numeral 101 designates a photosensitive drum (image bearing member), which is made of an organic photoconductor or amorphous silicon photoconductor, and driven to rotate in the counterclockwise direction of arrow at a predetermined process speed (peripheral speed).

The photosensitive drum 101, in its rotating process, is uniformly surface-charged to a predetermined polarity and potential by a charging device 102 such as a charging roller.

The charged surface of the photosensitive drum 101 is then subjected to scanning exposure with a laser beam 103 output from a laser optical box (laser scanner) 110. The laser optical box 110 outputs a laser beam 103 modulated (On/Off) in correspondence with time-series electrical digital pixel signals indicative of image information from an image signal generating device, not shown, such as an image reader. As a result, an electrostatic latent image corresponding to the image information pattern scanned and exposed is formed on the surface of the photosensitive drum 101. The reference numeral 109 designates a mirror which deflects the output laser beam from the laser optical box 110 to an exposure position on the surface of the photosensitive drum 101.

In the event of full-color image formation, a first color separation component image in a desired full-color image, for example, a yellow component image is scanned and exposed to form its latent image. The latent image is then developed as a yellow toner image by the actuation of a yellow developing device 104Y in a four-color developing apparatus 104. The yellow toner image is transferred to the surface of an intermediate transfer drum 105 in a primary transfer portion T1 as a contact portion (or approach portion) of the photosensitive drum 101 with (to) the intermediate transfer drum 105.

The surface of the rotary photosensitive drum 101 after the transfer of the toner image to the intermediate transfer drum 105 is cleaned up by a cleaner 107 removing adherent residues such as toner particles remaining after transfer.

The above-mentioned process cycle of charging, scanning exposure, development, primary transfer and cleaning is sequentially performed for remaining color separation component images in the desired full-color image, that is, for a second color separation component image (e.g., a magenta component image to be developed by the actuation of a magenta developing device 104M), a third color separation component image (e.g., cyan component image to be developed by the actuation of a cyan developing device 104C) and a fourth color separation component image (e.g., a black component image to be developed by the actuation of a black developing device 104BK). The four color toner images, namely yellow toner image, magenta toner image, cyan toner image and black toner image, are sequentially superimposed on and transferred to the surface of the intermediate transfer drum 105 to form composite color toner images corresponding to the desired color image.

The intermediate transfer drum 105 has a medium-resistance elastic layer and a high-resistance surface layer on its metal drum. In operation, the intermediate transfer drum 105 is driven to rotate in the clockwise direction of arrow at substantially the same peripheral speed as the photosensitive drum 101 while getting in contact with or approaching the photosensitive drum 101. Then a bias voltage is applied to the metal drum of the intermediate transfer drum 105 to cause a potential difference from the photosensitive drum 101, thereby transferring the toner images from the surface of the photosensitive drum 101 to the surface of the intermediate transfer drum 105.

The composite color toner images formed on the surface of the intermediate transfer drum 105 are transferred, in a secondary transfer portion T2 as a contact nip portion between the rotary intermediate transfer drum 105 and a transfer roller 106, to a recording material P as a material to be heated, which is fed from an unillustrated sheet feeding portion to the secondary transfer portion T2 at predetermined timing. The transfer roller 106 is supplied with a charge of the opposite polarity to that of toner to collectively transfer the composite color toner images from the intermediate transfer drum 105 to the recording material P.

The recording material P passing through the secondary transfer portion T2 is separated from the surface of the intermediate transfer drum 105, and conveyed to a heating apparatus 100 by which the unfixed toner image on the recording material P is subjected to the heating and fixing process. The recording material P as a material on which a color image has been formed is delivered to a delivery tray provided outside the apparatus. The heating apparatus 100 will be described in detail in the next item (2).

The surface of the rotary intermediate transfer drum 105 after the transfer of the color toner image to the recording medium P is cleaned up by a cleaner 108 removing adherent residues such as toner particles remaining after transfer and paper dust. The cleaner 108 remains in noncontact with the intermediate transfer drum 105 in its normal state, and is brought into and kept in contact with the intermediate transfer drum 105 during the execution of the secondary transfer of the color toner images to the recording material P.

The transfer roller 106 also remains in noncontact with the intermediate transfer drum 105 in its normal state, and is brought into and kept in contact with the intermediate transfer drum 105 through the recording material P during the execution of the secondary transfer of the color toner images.

The image forming apparatus of this example can also run in a monochrome, e.g., black-and-white, image printing mode, a two-sided image printing mode, or a multi-image printing mode.

In the two-sided image printing mode, a recirculation transporting mechanism reverses a front surface and a back surface of the recording material P a first side of which has already had a printed image, and feeds the upside-down recording material P to the secondary transfer portion T2 again. Then a second side of the recording material P is subjected to the transfer of a toner image thereto. After that, the recording material P is conveyed again to the heating apparatus 100 by which the unfixed toner image on the second side of the recording material is subjected to the fixing process. Thus the two-sided images are printed out.

In the multi-image printing mode, the recording material P which has already had a first printed image is fed again to the secondary transfer portion T2 through the recirculation transporting mechanism without a front surface and a back surface thereof being reversed. Then the recording material P is subjected to the transfer of a second toner image thereto. After that, the recording material P is conveyed again to the heating apparatus 100 by which the unfixed second, toner image is subjected to the fixing process. Thus the multiple images are printed out.

(2) Heating Apparatus 100

Figure 2:
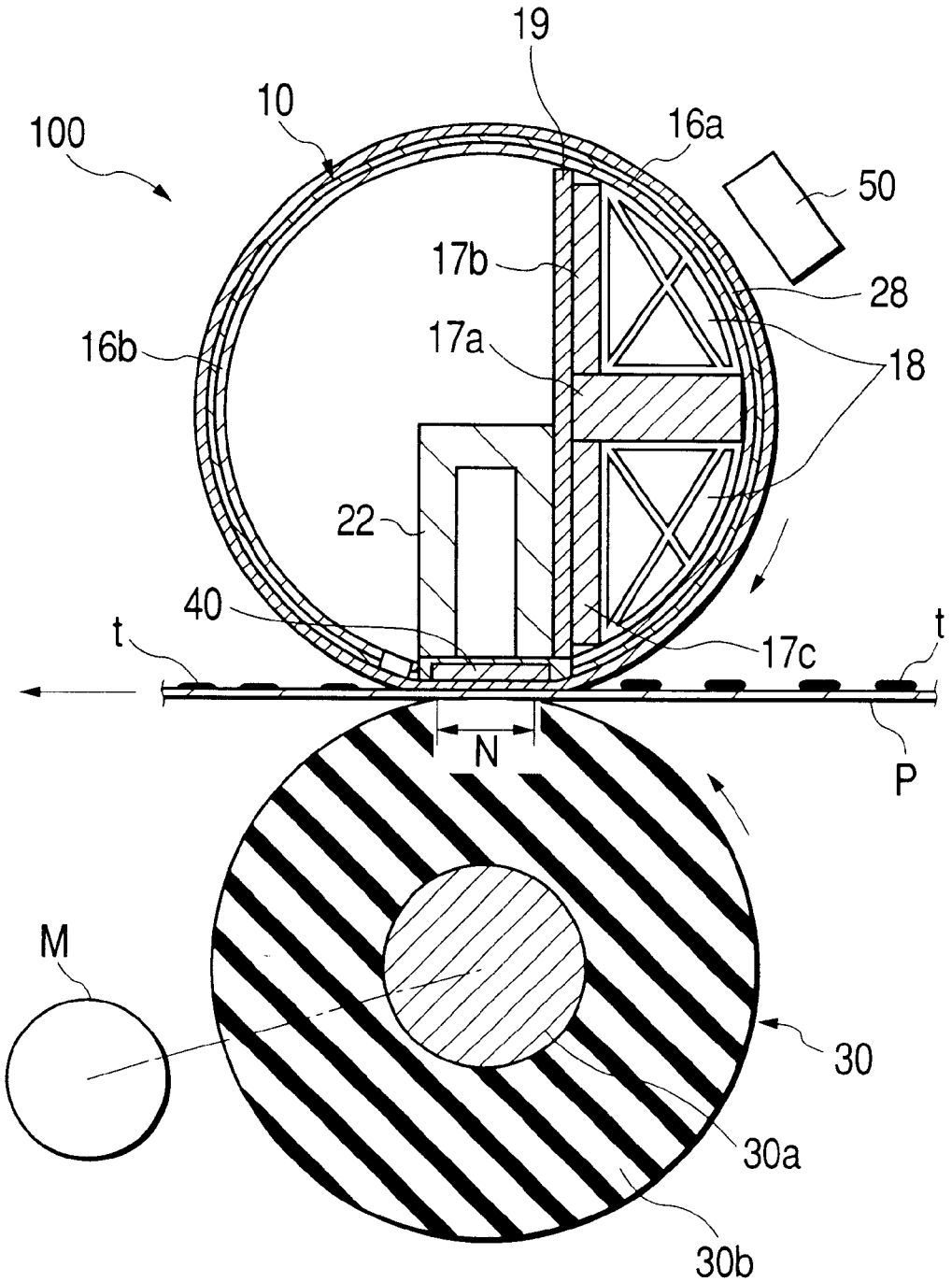
FIG. 2 is a sectional view of the image heating apparatus according to the present invention as viewed from a direction perpendicular to a traveling direction of a recording material.
Figure 3:
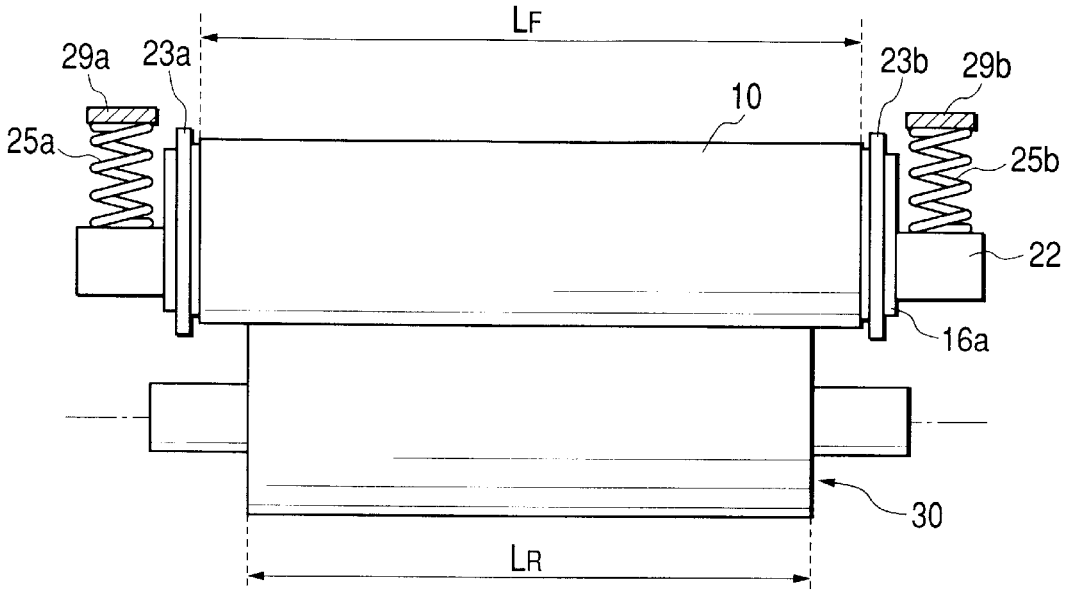
FIG. 3 is a schematic illustration of the image heating apparatus according to the present invention as viewed from the traveling direction of the recording material.
Figure 4:
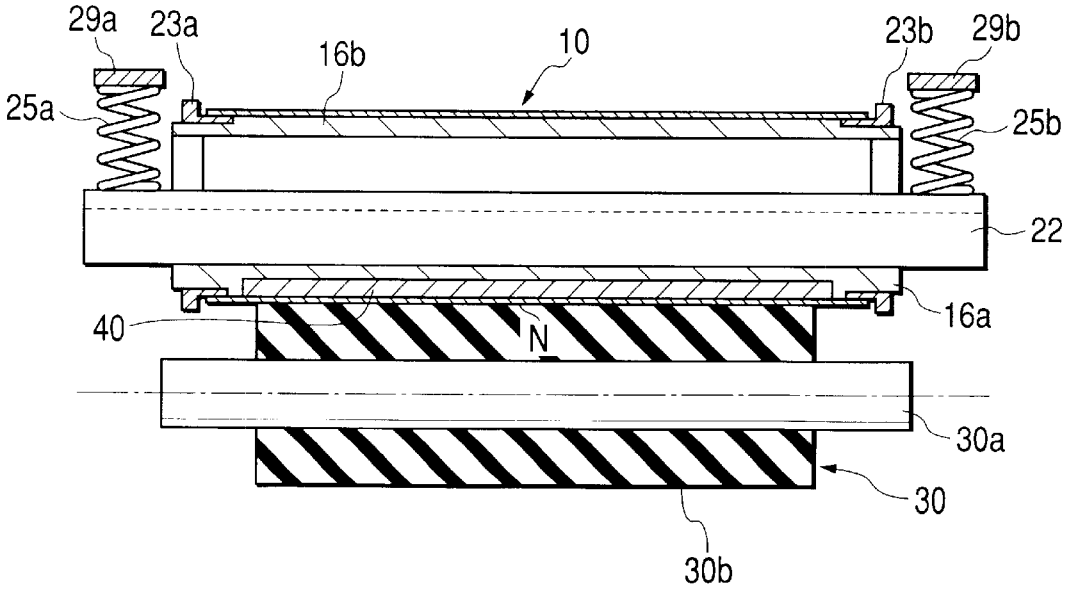
FIG. 4 is a sectional view of the image heating apparatus of the present invention as viewed from the traveling direction of the recording material.

In the embodiment, the heating apparatus 100 is an electromagnetic induction type heating apparatus. FIG. 2 is a transverse side model view of the main part of the heating apparatus 100 according to the embodiment. FIG. 3 and FIG. 4 are a front model view and a longitudinal front model view of the main part of the heating apparatus 100, respectively.

The magnetic field generating means comprises magnetic cores 17*a*, 17*b*, 17*c*, and an excitation coil 18. The magnetic cores 17*a*, 17*b* and 17*c* are high permeability members, which are preferably made of a material as used for a core of a transformer such as ferrite or permalloy. It is further preferable that the magnetic cores 17*a*, 17*b* and 17*c* are made of ferrite capable of exhibiting a low-loss characteristic even if a current of 10 kHz or higher in frequency is passed through the cores.

Figure 5:
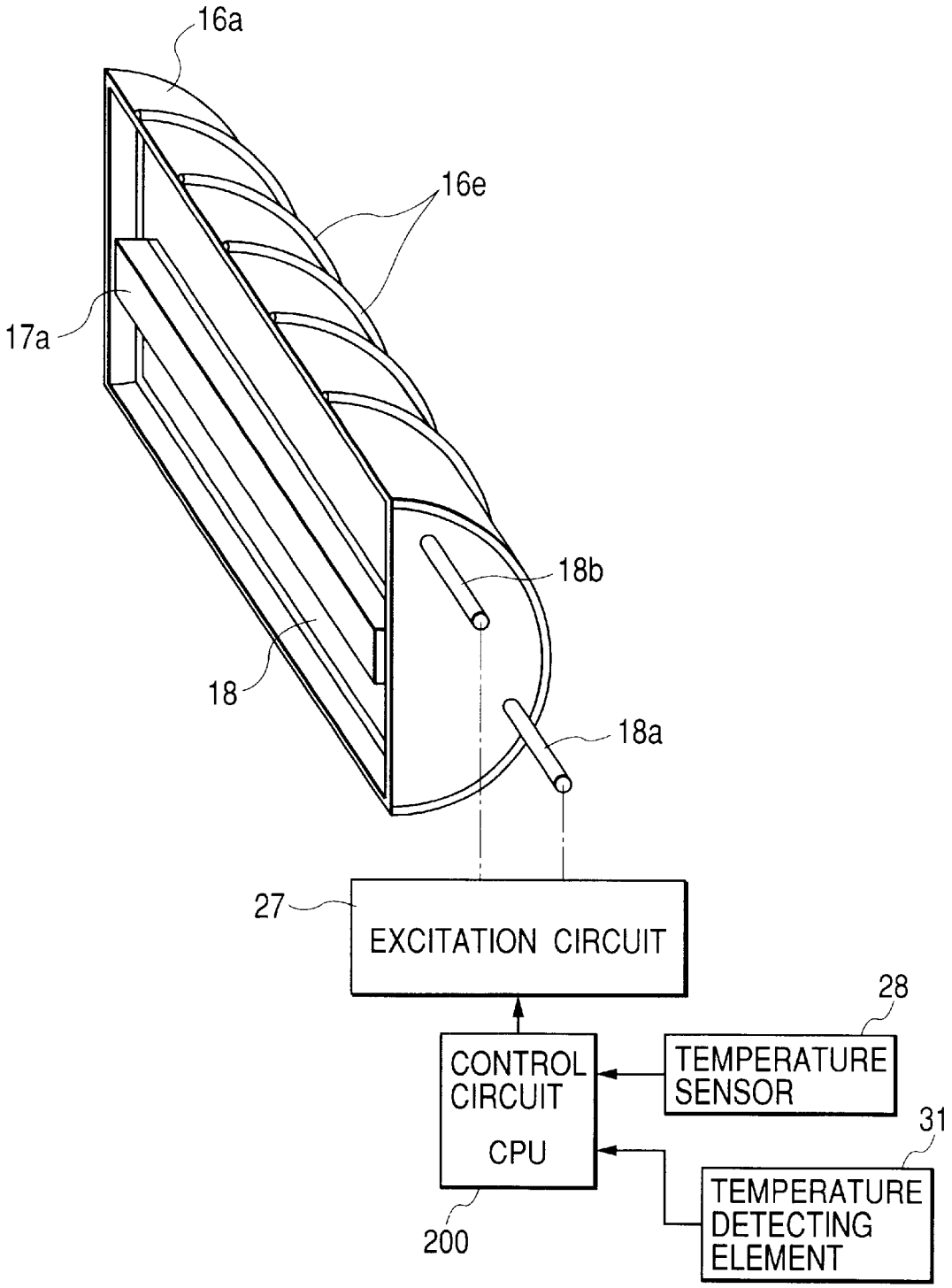
FIG. 5 illustrates a relationship between magnetic field generating means and an excitation circuit.

The excitation coil 18 is connected to an excitation circuit 27 through feeder wires 18*a* and 18*b* (FIG. 5). The excitation circuit 27 can generate a frequency of between 20 to 500 kHz using a switching power source.

The excitation coil 18 generates an alternating magnetic flux by an alternating current (high-frequency current) supplied from the excitation circuit 27.

The reference numerals 16*a* and 16*b* are gutter-shaped film guide members, which turn their opening sides on each other to form a substantially cylindrical member. A fixing film 10 as a cylindrically shaped electromagnetic induction type heat generating film is loosely fitted over the outside of the cylindrical member.

The film guide member 16*a* holds therein the magnetic field generating means, namely the magnetic cores 17*a*, 17*b*, 17*c* and the excitation coil 18.

On the other hand, the film guide member 16*b* is provided with a sliding member 40 inside the fixing film 10 in such a manner that the sliding member 40 faces the pressure roller 30 through a nip portion N.

The reference numeral 22 designates a sideways long, rigid pressure stay provided so that it comes in contact with an inside flat surface portion of the film guide member 16*b*.

The reference numeral 19 designates an insulating member 19 for insulating the rigid pressure stay 22 from the magnetic cores 17*a*, 17*b*, 17*c* and the excitation coil 18.

Flange members 23*a* and 23*b* are externally fitted on both right and left end portions of the assembly of the film guide members 16*a* and 16*b*. The flange members 23*a* and 23*b* are removably attached while fixing their right and left positions. As the fixing film 10 are rotated, the flange members 23*a* and 23*b* catch the end portions of the fixing film, which restricts an bias movement of the fixing film along the longitudinal direction of the film guide members.

A pressure roller 30 as a pressure member comprises a metal core 30*a* and a heat-resistant elastic material layer 30*b*. The heat-resistant, elastic material layer 30*b* is made of silicon rubber, fluororubber, fluororesin or the like, and formed concentrically with the metal core 30*a* in the shape of a roller so that the surface of the metal core 30*a* is covered with the heat-resistant elastic material layer 30*b*. Both end portions of the metal core 30*a* are rotatably supported by bearings between chassis side metal plates, not shown, of the apparatus.

Pressure springs 25*a* and 25*b* are compressively inserted between both end portions of the rigid pressure stay 22 and spring brackets 29*a* and 29*b* provided on the chassis side of the apparatus, respectively. The compressively inserted pressure springs 25*a* and 25*b* force the rigid pressure stay 22 to be pushed downward. The pushed-down stay 22, in turn, brings the sliding member 40 on the undersurface of the film guide member 16*a* into pressure contact with the pressure roller 30 through the fixing film 10 to form a predetermined-width fixing nip portion N.

The pressure roller 30 is driven by driving means M to rotate in the counterclockwise direction of arrow, which causes friction between the pressure roller 30 and the outside surface of the fixing film 10 to cause a torque on the fixing film. The fixing film 10 is rotated around the outside of the film guide members 16*a* and 16*b* in the clockwise direction of arrow at a peripheral speed substantially equivalent to that of the pressure roller 30. At this time, the inside surface of the fixing film 10 slides in close contact with the undersurface of the sliding member 40 in the fixing nip portion N.

In this case, it is preferable to put a lubricant such as a heat-resistant grease between the undersurface of the sliding member 40 and the inside surface of the fixing film 10 in the fixing nip portion N so as to reduce friction therebetween in the fixing nip portion N.

Further, as shown in FIG. 5, projected ribs 16e are formed on the peripheral surface along the longitudinal direction with predetermined spaces. The projected ribs 16*e* are operative to reduce a contact sliding resistance between the peripheral surface of the film guide member 16*a* and the inside surface of the fixing film 10, and hence a rotating load on the fixing film 10. These projected ribs 16*e* may also be formed on the film guide member 16*b*.

Figure 6:
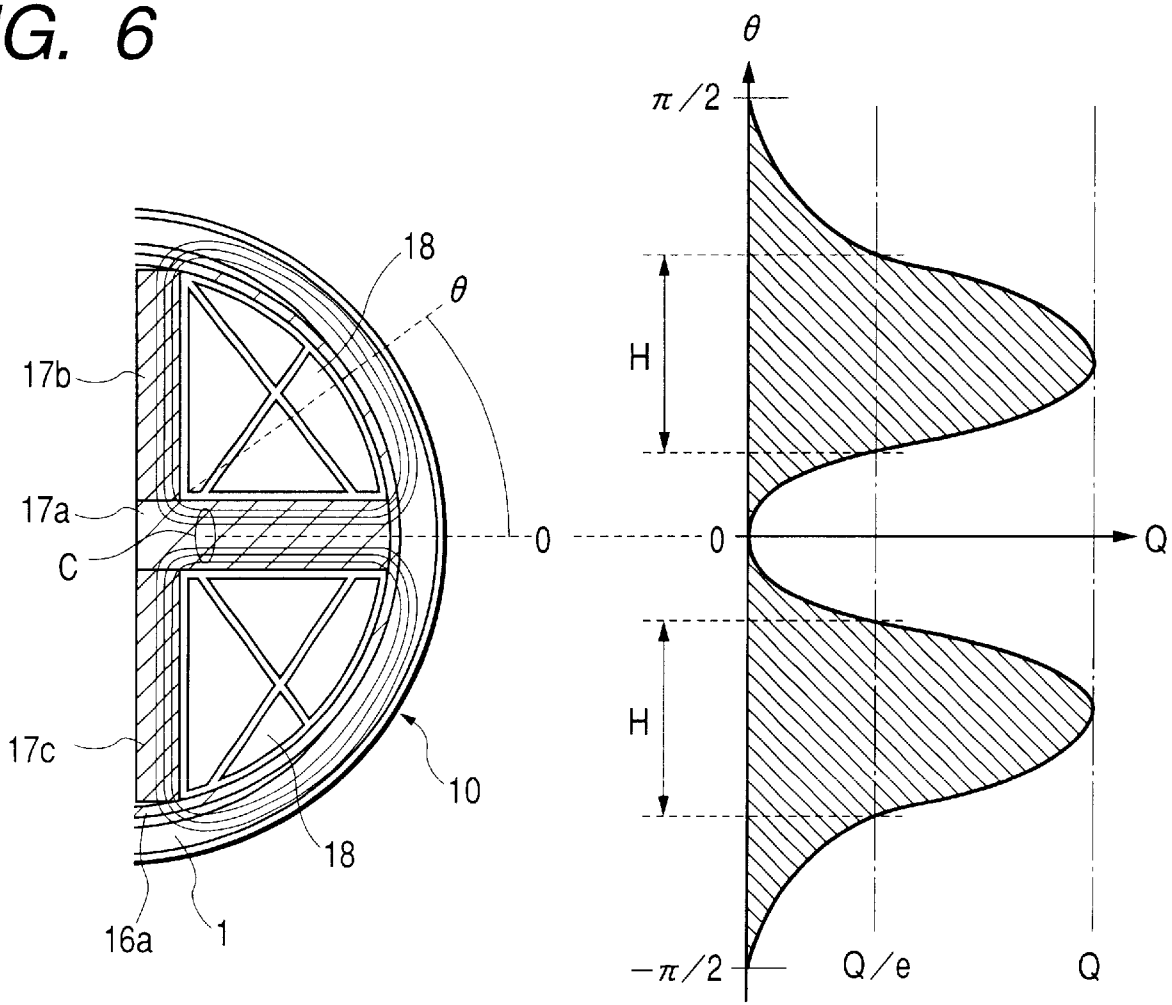
FIG. 6 illustrates a relationship between a construction of the magnetic field generation means and a heating amount of a rotary member.

FIG. 6 schematically illustrates how an alternating magnetic flux is generated, in which a magnetic flux C indicates part of the alternating magnetic flux generated.

The alternating magnetic flux C conducted to the magnetic cores 17*a*, 17*b* and 17*c* creates an flow of eddy current in an electromagnetic induction hating layer 1 of the fixing film 10 between the magnetic cores 17*a* and 17*b*, and the magnetic cores 17*a* and 17*c*. The eddy current generates Joule heat (eddy current loss) in the electromagnetic induction heating layer 1 by a specific resistance of the electromagnetic induction hating layer 1. Calorific values Q are determined by the density of the magnetic flux passing through the electromagnetic induction heating layer 1; they are distributed as shown in the graph of FIG. 6. In the graph of FIG. 6, the ordinate shows peripheral positions on the fixing film 10 represented by an angle θ from zero taken at the center of the magnetic core 17*a*, while the abscissa shows the calorific values Q distributed in the electromagnetic induction heating layer 1 of the fixing film 10. If the maximum calorific value is Q, a heating area H is defined as an area containing calorific values of Q/e or more, that is, as an area in which an calorific value enough for fixing can be obtained.

A temperature control system including temperature detecting means controls a current supply to the excitation coil 18 to regulate the temperature of the fixing film 10, that is, the temperature of the fixing nip portion N so as to be maintained at a predetermined temperature. The reference numeral 28 (FIGS. 2 and 5) designates a temperature sensor such as a thermistor for sensing the temperature of the fixing film 10. In the embodiment, as shown in FIG. 2, the temperature sensor 28 is arranged in the vicinity of a heating peak position in such a manner that the temperature sensor 28 is exposed from the outside surface of the film guide member 16*a*. The heating peak position is a position on which the magnetic flux is concentrated. In operation, the temperature sensor 28 comes in contact with the inside surface of the fixing film 10 to sense the temperature of the fixing film 10. The temperature measured by the temperature sensor 28 is input as temperature information to a CPU 200 (FIG. 5). The CPU 200 controls the excitation circuit 27 on the basis of the temperature information to control the current supply to the excitation coil 18 so as to regulate the temperature of the fixing film 10 to a predetermined temperature.

Suppose that a recording material P with an unfixed toner image t borne thereon is fed to the fixing nip portion N in such a condition that the fixing film 10 is rotated with its temperature regulated to a set temperature. In this case, the image surface is brought into close contact with the outside surface of the fixing film 10 in the fixing nip portion N, nipped and conveyed together with the fixing film 10 through the fixing nip portion N. While the recording material P is nipped and conveyed together with the fixing film 10 through the fixing nip portion N, the unfixed toner image t on the recording material P is heat-fixed. After passing through the fixing nip portion N, the recording material P is separated from the fixing film 10 and conveyed to the delivery portion. The heat-fixed toner image on the recording material is cooled down after passing through the fixing nip portion N to become a permanent fixed image.

In the embodiment, as shown in FIG. 2, a thermo switch 50 as a temperature detecting element is arranged in an opposed position to the heating area H (FIG. 6) of the fixing film 10 so that power feeding to the excitation coil 18 will be intercepted at the time of thermal runaway.

Figure 7:
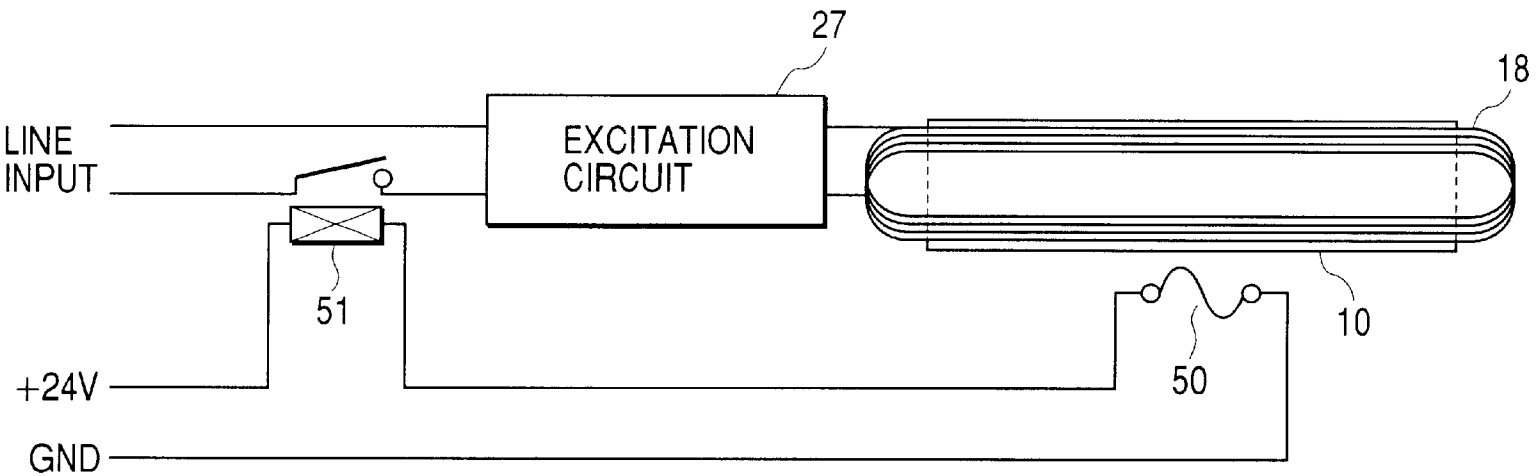
FIG. 7 illustrates a safety circuit provided in one preferred embodiment of the present invention.

FIG. 7 is a circuit diagram of a safety circuit used in the embodiment. The thermo switch 50 as the temperature detecting element is such that a +24-volt DC power source is connected to a relay switch 51 in series. When the thermo switch is flipped off, power feeding to the relay switch 51 is intercepted, which makes the relay switch 51 operate to intercept power feeding to the excitation circuit 27, and hence to the excitation coil 18. The thermo switch 50 sets its flip-off temperature to 220° C.

The thermo switch 50 is also arranged opposite to the heating area H of the fixing film 10 and in noncontact with the outside surface of the fixing film 10. The distance between the thermo switch 50 and the fixing film is about 2 mm, which makes it possible to prevent the fixing film 10 from coming in contact with the thermo switch 50 and getting damaged, and hence a degradation of the fixed image after endurance.

According to the embodiment, even if the heating apparatus is stopped in such a condition that a sheet is nipped in the fixing nip portion N while heating the fixing film 10 due to the continuation of power feeding to the excitation coil 18, since the fixing nip portion N in which the sheet is nipped is not heated, the sheet is not heated directly. Further, since the thermo switch 50 is provided for the highly calorific heating area H, power feeding to the excitation coil 18 is intercepted by the relay switch 51 when the thermo switch 50 detects a temperature of 220° C. and is flipped off.

In the embodiment, since the ignition temperature of paper is about 400° C., heating of the fixing film can be stopped without igniting the sheet.

A temperature fuse can also be used as the temperature detecting element instead of the thermo switch.

A) Excitation Coil 18

The excitation coil 18 is formed by winding a wire harness plural times. The wire harness as a conductor (cable) constituting a coil (wire rings) is made by grouping two or more thin copper wires each of which is covered with an insulating material. In the embodiment, the excitation coil 18 is formed with ten turns of wire rings.

The insulating cover is preferably made by a heat-resistant cover material by taking into account heat conduction due to heating of the fixing film 10. For example, a cover material made of polyamide-imide or polyimide may be used.

Further, the excitation coil 18 may improve its wire-ring density by the application of pressure from the outside.

The excitation coil 18 is shaped in conformity with a curved surface of the heating layer as shown in FIG. 2 or 6. In the embodiment, the distance between the heating layer 1 of the fixing film 10 and the excitation coil 18 is set to about 2 mm.

The film guide member 16*a* serving as an excitation coil supporting member concurrently is preferably made of a material having high-insulating and high heat-resistant properties. For example, phenol resin, fluororesin (PFA resin, PTFE resin or FEP resin), polyimide resin, polyamide resin, polyamide-imide resin, PEEK resin, PES resin, LCP resin etc. are selectable.

The closer the distance between the heating layer of the fixing film and the magnetic cores 17*a*, 17*b*, 17*c* and the excitation coil 18, the higher the magnetic-flux absorption efficiency. However, since the efficiency is remarkably reduced when the distance is above 5 mm, it is preferable to set the distance to 5 mm or less. The distance between the heating layer of the fixing film 10 and the excitation coil 18 is not necessarily kept constant as long as it is 5 mm or less.

With feeder wires 18*a* and 18*b* (FIG. 5) from the film guide member 16*a* that holds the excitation coil 18, the outside of wire harness is covered with an insulating material.

B) Fixing Film 10

Figure 8:
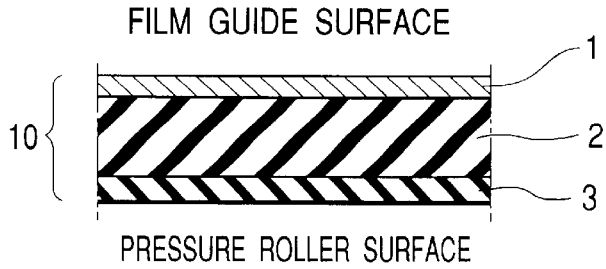
FIG. 8 is a sectional view illustrating a layer structure of a fixing film according to the embodiment of the present invention.

FIG. 8 is a model view of a layer structure of the fixing film 10 according to the embodiment. The fixing film 10 according to the embodiment has a multi-layer structure. The multi-layer structure comprises a heating layer 1 made of a metal film or the like as a base layer of the electromagnetic induction heating type fixing film 10, an elastic layer 2 laminated on the outside surface of the heating layer 1, and a releasing layer 3 laminated on the outside surface of the elastic layer 2. For bonding between the heating layer 1 and the elastic layer 2, and the elastic layer 2 and the releasing layer 3, primer layers (not shown) may be provided between the layers, respectively. In the cylinder-shaped fixing film 10, the heating layer 1 comes inside and the releasing layer 3 comes outside. As mentioned above, an alternating magnetic flux is exerted on the heating layer 1 to cause a flow of eddy current in the heating layer 1, thus generating heat. The heat is transmitted through the elastic layer 2 and the releasing layer 3 to a toner image on the recording material P as a heated material to be passed through the fixing nip portion N, thus heat-fixing the toner image.

a. Heating Layer 1

The heating layer 1 is preferably made of a ferromagnetic metal material such as nickel, iron, ferromagnetic SUS, nickel-cobalt alloy.

Although nonmagnetic metal may be used, nickel, iron, magnetic stainless steel, cobalt-nickel alloy etc. having high magnetic-flux absorbing properties better work.

It is preferably to set the thickness of the heating layer equal to or less than 200 μm, and thicker than a skin depth represented by the following equation:

$$\sigma=503\times(\rho/f\mu)^{1/2}$$

where σ(m) is a skin depth, f(Hz) is a frequency of the excitation circuit, μ is a magnetic permeability, and ρ(Ωm) is a resistivity.

Figure 9:
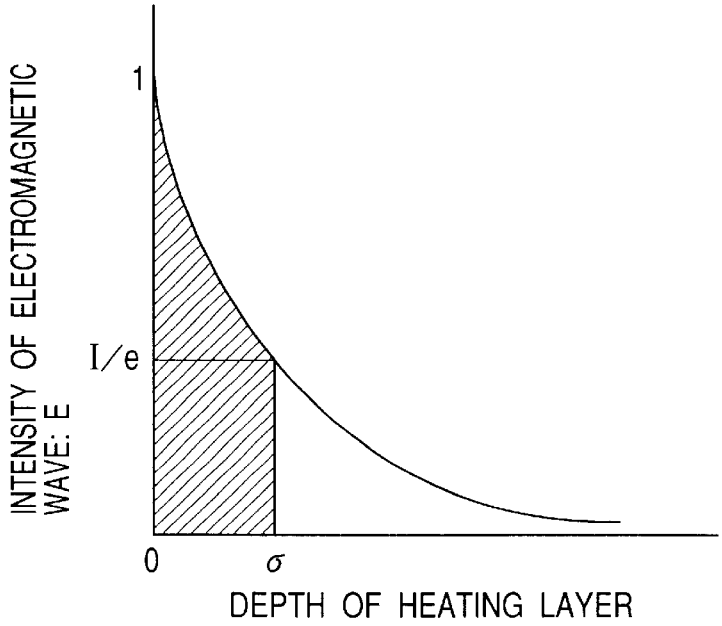
FIG. 9 is a graph illustrating a relationship between depth of a heat-generating layer and an intensity of an electromagnetic wave.

The skin depth means how deep an electromagnetic wave is absorbed by electromagnetic induction, indicating that the strength of the electromagnetic wave in a deeper place is 1/e or less. In other words, most energy is absorbed in the skin depth (FIG. 9).

The thickness of the heating layer 1 is preferably 1 to 100 μm. If the thickness of the heating layer is less than 1 μm, it is not enough to absorb most electromagnetic energy, thereby reducing the efficiency. On the other hand, if the thickness of the heating layer is more than 100 μm, it becomes too rigid to be bent, which is not practical for use as a rotary member. From these standpoints, it is preferable to set the thickness of the heating layer 1 in a range of 1 to 100 μm.

b. Elastic Layer 2

The elastic layer 2 is made of a highly heat-resistant, highly heat-conductive material such as silicon rubber, fluororubber, fluorosilicon rubber etc.

The thickness of the elastic layer 2 is preferably set in a range of 10 to 500 μm, enough in thickness to secure the quality of fixed images. In the event of printing a color image, particularly a photographic color image, a solid image is formed over a large area of the recording material P. In such a case, the heating surface (releasing layer 3) cannot follow surface irregularities of the recording material P or toner layer, which in turn causes heat irregularities and hence uneven brightness of the image between a high heat-transfer portion and a low heat-transfer portion. The more the amount of heat transfer, the higher the glossiness. On the other hand, the less the amount of the heat transfer, the lower the glossiness. If the thickness of the elastic layer 2 is less than 10 μm, it cannot follow surface irregularities of the recording material or toner layer to cause uneven brightness of the image. On the other hand, if the thickness of the elastic layer 2 is more than 1000 μm, the elastic layer increases its heat resistance to reduce the response to a temperature. It is further preferable to set the thickness of the elastic layer 2 in a range of 50 to 500 μm.

If the hardness of the elastic layer 2 is too high to follow surface irregularities of the recording material or toner image, uneven brightness of the image is also caused. Therefore, it is preferable to set the hardness of the elastic layer 2 to 60 deg. or less (JIS-A: JIS K in case of use of A type measurement equipment), further preferably to 45 deg.

The heat conductivity λ of the elastic layer 2 is preferably set in a range of 0.25 to 0.84 (W/m·° C.). If the heat conductivity λ is lower than 0.25 (W/m·° C.), the heat resistance increases to delay a rise time of temperature on the surface (releasing layer 3) of the fixing film. On the other hand, if the heat conductivity λ is higher than 0.84 (W/m·° C.), the hardness increases or a permanent distortion due to compression becomes worse. Therefore, it is preferable to set the heat conductivity λ in a range of 0.25 to 0.84 (W/m·° C.), further preferably in a range of 0.33 to 0.63 (W/m·° C.).

c. Releasing Layer 3

The releasing layer 3 is made of a highly releasable, heat-resistant material such as fluororesin (PFA, PTFE or FEP), silicon resin, fluorosilicon rubber, fluororubber, silicon rubber etc.

The thickness of the releasing layer 3 is preferably set in a range of 1 to 100 μm. If the thickness of the releasing layer 3 is less than 1 μm, a less releasable portion is caused due to its uneven coating, while if it is more than 100 μm, the heat conductivity becomes worse. In particular, a resin type of releasing layer tends to be too hard to secure the effect of the elastic layer 2.

Figure 10:
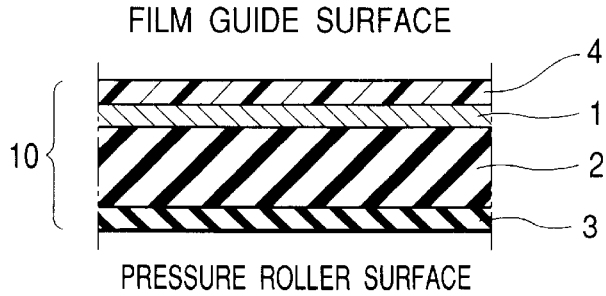
FIG. 10 is a sectional view illustrating a layer structure of a fixing film according to another embodiment of the present invention.

Further, as shown in FIG. 10, a heat-insulating layer 4 may be provided on the film guide surface side of the heating layer 1 (opposite side of the heating layer 1 to the elastic layer 2).

The heat-insulating layer 4 is preferably made of heat-insulating resin such as fluororesin (PFA resin, PTFE resin or FEP resin), polyimide resin, polyamide resin, polyamide-imide resin, PEEK resin, PES resin, PPS resin, etc.

Further, it is preferable to set the thickness of the heat-insulating layer 4 in a range of 10 to 1000 μm. If the thickness of the heat-insulating layer 4 is less than 10 μm, a sufficient heat insulating effect and durability are not obtained. On the other hand, if it is above 1000 μm, the distance of the heating layer 1 from the magnetic cores 17*a*, 17*b*, 17*c* and the excitation coil 18 becomes longer, which makes it hard to sufficiently absorb a magnetic flux into the heating layer 1.

The heat-insulating layer 4 can insulate heat generated in the heating layer 1 to prevent the heat from heading toward the inside of the fixing film, which increases heat supplying efficiency to the recording material P, compared to the case the heat-insulating layer 4 is not provided.

C) Apparatus Temperature Control

Figure 11:
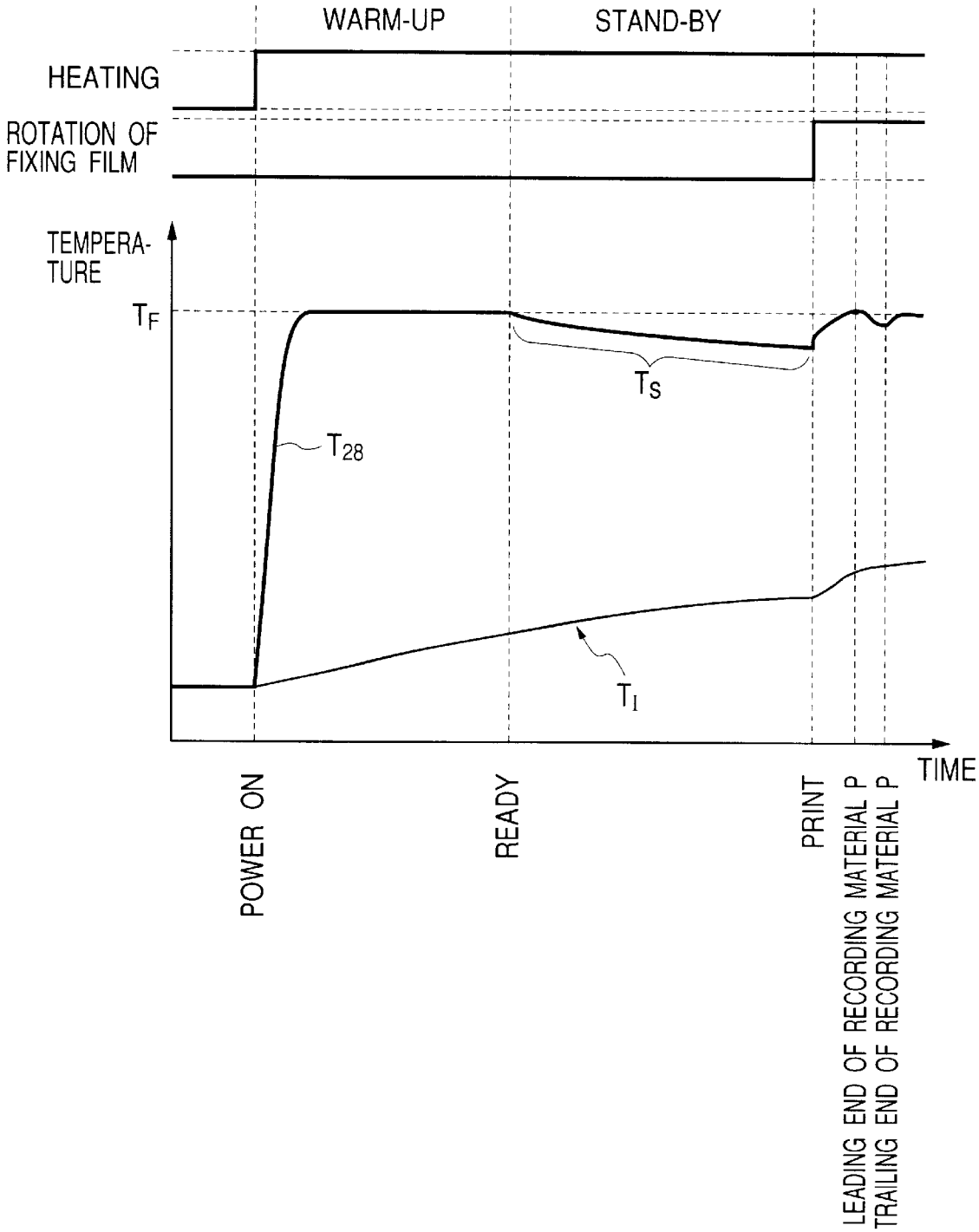
FIG. 11 illustrates a control process according to a first embodiment of the present invention.

Referring next to FIG. 11, a method of controlling apparatus temperature as characterized by the present invention will be described in detail.

FIG. 11 chooses time as the abscissa, showing from the left hand a transition of the status of the image forming apparatus main body from power-on to warm-up, ready, standby and print start. On the other hand, temperature is chosen as the ordinate. The reference sign $T_F$ designates a regulated temperature at the time of fixing an image. The reference sign $T_{28}$ designates a detected temperature of the thermistor 28. In the embodiment, the fixing device continues to be warm-up state until the temperature of the excitation coil 18 reaches 45° C. (and it produces a ready signal when the temperature of the excitation coil 18 reaches 45° C.). During this period, since the temperature of the fixing film 10 reaches $T_F$, the temperature is regulated to maintain $T_F$ after reaching $T_F$ until the ready signal is produced. Thus the regulated temperature during the warm-up period is set equal to the regulated temperature during the fixing period. $T_S$ represents a set temperature in the heating area H (FIG. 6) of the fixing film 10 during a standby period. The set temperature is determined according to a temperature $T_I$ of the coil 18 as described later. It should be noted that in FIG. 11 a curve of the set temperature $T_S$ during the standby period is overlapped on that of a temperature $T_{28}$ sensed by the thermistor 28. $T_I$ represents a temperature in a longitudinally central portion of the excitation coil 18 as the magnetic field generating means. The temperature $T_I$ is measured by the temperature detecting element 31 (FIG. 5). As shown in FIG. 11, the curves $T_{28}$ and $T_I$ represent temperature changes in the fixing film 10 and the excitation coil 18, respectively.

When the temperature sensed by the temperature detecting element 31 reaches 45° C., the ready signal is produced to change the warm-up state to a standby state. At this time, the fixing film 10 is stopped, and temperature regulation is so performed that the heating area H of the fixing film 10 is maintained at the temperature $T_S$. The temperature regulation is controlled by the CPU 200 and the excitation circuit 27 (FIGS. 2 and 5) on the basis of a temperature sensed by the thermistor 28 that is in contact with the heating area H on the inside surface of the fixing film 10. Such temperature regulating control is performed by varying the frequency of high-frequency current applied to the excitation coil 18 to regulate the duty of supplied power.

If the standby state is performed with the fixing film 10 stopped, since the fixing film 10 has a small heat capacity and the magnetic field generating means seldom self-heats, a temperature rising speed of the fixing film varies depending on the temperature of the magnetic field generating means. If the temperature of the magnetic field generating means is low, part of the calorific value of the fixing film is used for rising the temperature of the magnetic field generating means.

From this standpoint, the standby temperature $T_S$ is so set that it satisfies the following relationship (expression 1):

$$T_F \leqq (T_I + T_S)/1.25 \quad (1)$$

The temperature setting allows the fixing film 10 to rise its temperature up to the regulated fixing temperature $T_F$ within a time period from the printer receives printing start signal until the leading end of the recording material P reaches the fixing nip portion N of the heating apparatus 100.

As an example, if $T_F$ is 180° C., the apparatus is shifted to a ready state when $T_I \geqq 45°$ C. so that the film temperature will reach 180° C. during the warm-up period and the above expression (1) will be satisfied.

As the temperature $T_I$ of the excitation coil 18 as the magnetic field generating means rises during the standby period, the standby temperature $T_S$ under control is reduced to satisfy the above expression (1).

In FIG. 11, although the printing process is started before thermal equilibrium is achieved, the temperature $T_S$ ends up a temperature at which the hating apparatus including the fixing film 10, the magnetic field generating means 18 and 17 and the pressure roller 30 reaches the thermal equilibrium state.

If the temperature of the magnetic field generating means is low, the temperature of the fixing film 10 is made rise. On the other hand, as the temperature of the magnetic field generating means increases, the temperature of the fixing film is reduced. Such temperature regulation makes it possible to make the temperature of the fixing film 10 stably rise up to the fixable temperature $T_F$ before the leading end of the recording material P reaches the fixing nip portion N after the printing process is started.

It is preferable to set the standby temperature $T_S$ of the fixing film 10 lower than a temperature at which the unfixed toner image t on the recording material P adheres onto the fixing film 10 due to overheating, that is, a hot offset temperature. If the printing process is started at a temperature equal to or higher than the hot offset temperature, a high-quality image cannot be obtained.

Further, the temperature of the fixing film 10 must be equal to or less than the heat-resistant temperature of material constituting the fixing film.

It should be noted that the standby temperature $T_S$ under control can be reduced as appropriate by predicting the temperature $T_I$ of the magnetic field generating means, instead of measurement thereof, on the basis of time constants indicative of temperature changes of the fixing film 10, and the magnetic field generating means 17 and 18.

Further, although in the embodiment the temperature detecting elements 28, 31 are arranged in the longitudinal center of the fixing device, it is preferable to arrange the temperature detecting elements within a sheet-passing area in the longitudinal direction to capture a temperature state of the sheet-passing portion through which the recording material passes.

In the above-mentioned control process, as shown in FIG. 11, surface temperatures of the fixing film 10 and the pressure roller 30 have reached respective fixable temperatures at the time the leading end of the recording material P reaches the heating apparatus 100. This results in the shortest first printing time without occurrence of a fixing failure even in a color image.

In such a control method according to the embodiment that the fixing film 10 as the electromagnetic induction-heating rotary body is stopped, the rotating ratio of the fixing film 10 during the standby period to the endurance of the heating apparatus 100 is zero. Therefore, a reduction in the number of printable sheets due to deterioration of the film can be eliminated even when the printer is used infrequently and hence its standby state lasts a long time.

Further, a wasted supply of energy can be prevented, which has the advantage of rising temperature in the apparatus.

In the embodiment, since toner containing a low softening substance, no oil-applying mechanism is provided in the heating apparatus 100 for offset prevention. However, such an oil-applying mechanism may be provided if toner that does not contain a low softening substance is used. Alternatively, a cooling portion may be provided after the fixing nip for performing cooling separation. Furthermore, oil application or cooling separation may be performed even when the toner contains a low softening substance.

In the above embodiment, description was made about the four-color image forming apparatus. However, if the present invention is applied to a monochrome or one-pass multicolor image forming apparatus, the fixing film 10 can be constituted of the heating layer 1 and the releasing layer 3 alone without the intervention of the elastic layer 2.

Second Embodiment

The second embodiment features that the fixing film 10 in the first embodiment is rotated during the warm-up period. The other components take the same structure as those of the first embodiment, and description thereof will be omitted.

Figure 12:
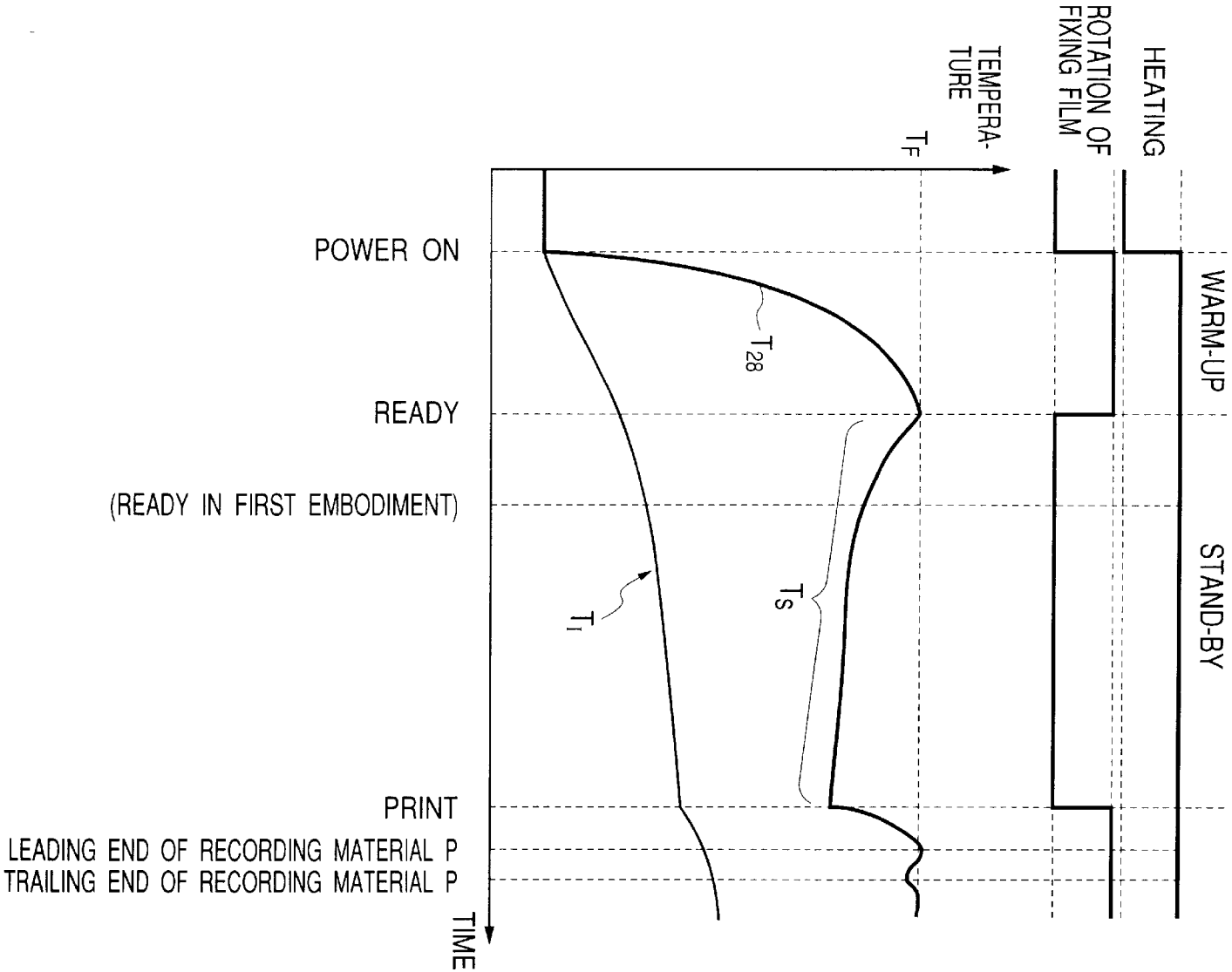
FIG. 12 illustrates a control process according to a second embodiment of the present invention.

Like FIG. 11, FIG. 12 chooses time as the abscissa, showing from the left hand a transition of the status of the image forming apparatus main body from power-on to warm-up, ready, standby and print start. On the other hand, temperature is chosen as the ordinate, showing a regulated temperature at the time of fixing an image. Further, $T_S$ represents a set temperature of the heating area H on the fixing film 10 during the standby period. Like in the first embodiment, the set temperature $T_S$ is determined according to a temperature $T_I$ of the coil 18. It should be noted that in FIG. 12 a curve of the set temperature $T_S$ during the standby period is overlapped on that of a temperature $T_{28}$ sensed by the thermistor 28. $T_I$ represents a temperature in a longitudinally central portion of the excitation coil 18 as the magnetic field generating means. The temperature $T_I$ is measured by the temperature detecting element 31 (FIG. 5). As shown in FIG. 12, the curves $T_{28}$ and $T_I$ represent temperature changes in the fixing film 10 and the excitation coil 18 as the magnetic field generating means, respectively.

In the embodiment, heating (signal) is on in synchronism with main body's power on to start rotation of the fixing film 10. The fixing film 10 is made ready after rising its temperature to $T_F$ and shifted to the standby state. After the standby period, since the control process is the same as in the first embodiment, description thereof will be omitted.

In the embodiment, the fixing film 10 is rotated in synchronism with heating operation in response to the main body's power on, which makes the temperature of the pressure roller 30 rise its temperature. Further, since the heat capacity becomes large due to the rotation of the film, that is, since heat is supplied to the pressure roller as well as the film, the amount of power-on per unit time also increases compared to the case the film is stopped. The excitation coil 18 as the magnetic field generating means has a copper loss, the temperature of the coil itself rises fast as supplied power increases. As a result, the temperature rising speed of the magnetic field generating means becomes faster than that in the first embodiment in which the fixing film 10 is stopped.

Thus the time elapsed from power-on to ready for the main body can be reduced, providing improved usability to users.

In the embodiment the fixing film 10 is shifted to the ready state at the time the temperature of the fixing film 10 reaches the fixable temperature $T_F$, but it can be shifted at the time the expression (1) shown in the first embodiment is satisfied. In this case, the fixing film 10 can be shifted to the ready state at a temperature lower than the temperature $T_F$, which makes it possible to further reduce the warm-up period.

The present invention are not limited to the control processes at the time of power-on, and it is also effective in starting up the heating apparatus 100 from a heating-off mode such as a power saving mode.

Further, the heating apparatus according to the present invention is not limited to the image heating/fixing apparatus according to the embodiment. It can be widely used as an image heating apparatus for heating an image bearing recording material to alter surface characteristics such as glossiness, an image heating apparatus for heating an image bearing recording material to temporarily fix the image, a heating apparatus for drying-out and laminating of sheet-like paper to be fed, etc.

The present invention should not be bound to the above-mentioned embodiments, and it includes modifications based on the same technical principles.

What is claimed is:

1. An image heating apparatus for heating an image formed on a recording material, comprising:

a heating member;

magnetic field generating means for generating a magnetic field to induce an eddy current in said heating member;

a temperature detecting element for detecting a temperature of said heating member; and control means for controlling an electrical supply to said magnetic field generating means so that the temperature detected by said temperature detecting element is maintained at a set temperature, wherein said control means sets the set temperature in accordance with a temperature of said magnetic field generating means.

2. An image heating apparatus according to claim 1, wherein said control means sets the set temperature in accordance with the temperature of said magnetic field generating means during a stand-by period.

3. An image heating apparatus according to claim 1, further comprising a second temperature detecting element for detecting the temperature of said magnetic field generating means, wherein said control means sets the set temperature in accordance with the temperature detected by said second temperature detecting element.

4. An image heating apparatus according to claim 1, wherein said heating member includes a rotation member, and wherein while the set temperature is set to a standby temperature, said control means controls the electrical supply to said magnetic field generating means and said rotation member is maintained in a stoppage of rotation.

5. An image heating apparatus according to claim 1, wherein said control means variably sets $T_S$ to satisfy the following relationship:

$$T_F \leqq (T_I + T_S)/1.25 \quad (1)$$

Where $T_F$ is a temperature, which is set by said control means when an image formed on a recording material is heated, $T_I$ is the temperature of said magnetic field generating means, and $T_S$ is a temperature, which is set by said control means during a standby period.

6. An image heating apparatus according to claim 1, wherein said control means variably sets the set temperature so that the temperature of said heating member is lower than a temperature at which a part of a heated material is offset to said heating member.

7. An image heating apparatus according to claim 1, wherein said control means predicts the temperature of said magnetic field generating means, and said control means variably sets the set temperature of said heating member in accordance with a predicted temperature.

8. An image heating apparatus for heating an image formed on a recording material, comprising:

a heating member:

magnetic field generating means for generating a magnetic field to induce an eddy current in said heating member;

a temperature detecting element for detecting a temperature of said heating member; and control means for controlling an electrical supply to said magnetic field generating means so that the temperature detected by said temperature detecting element is maintained at a set temperature, wherein said control means sets the set temperature to a first set temperature when a temperature of said magnetic field generating means is a first temperature, and sets the set temperature to a second set temperature lower than the first set temperature when the temperature of said magnetic field generating means is a second temperature higher than the first temperature.

9. An image heating apparatus according to claim 8, wherein said control means sets the set temperature in accordance with the temperature of said magnetic field generating means during a standby period.

10. An image heating apparatus according to claim 8, further comprising a second temperature detecting element for detecting the temperature of said magnetic field generating means, wherein said control means sets the set temperature in accordance with the temperature detected by said second temperature detecting element.

11. An image heating apparatus according to claim 8, wherein said heating member includes a rotation member, and wherein while the set temperature is set to a standby temperature, said control means controls the electrical supply to said magnetic field generating means and said rotation member is maintained in a stoppage of rotation.

12. An image heating apparatus according to claim 8, wherein said control means variably sets $T_s$ to satisfy the following relationship:

$$T_F \leqq (T_I + T_S)/1.25 \quad (1)$$

Where $T_F$ is a temperature, which is set by said control means when an image formed on a recording material is heated, $T_I$ the temperature of said magnetic field generating means, and $T_S$ is a temperature, which is set by said control means during a standby period.

13. An image heating apparatus according to claim 8, wherein said control means variably sets the set temperature so that the temperature of said heating member is lower than a temperature at which a part of a heated material is offset to said heating member.

14. An image heating apparatus according to claim 8, wherein said control means predicts the temperature of said magnetic field generating means, and said control means variably sets the set temperature of said heating member in accordance with a predicted temperature.

15. An image heating apparatus for heating an image formed on a recording material, comprising:

a heating member;

magnetic field generating means for generating a magnetic field to induce an eddy current in said heating member;

a temperature detecting element for detecting a temperature of said heating member; and control means for controlling an electrical supply to said magnetic field generating means so that the temperature detected by said temperature detecting element is maintained at a target temperature, wherein said control means variably sets the target temperature lest a temperature of said magnetic field generating means excessively increases when said apparatus is at least in a predetermined state.

16. An image heating apparatus according to claim 15, wherein said control means includes means for predicting the temperature of said magnetic field generating means in accordance with the temperature detected by said temperature detecting element.

17. An image heating apparatus according to claim 15, wherein when said apparatus is in a standby state, said control means variably sets the target temperature lest the temperature of said magnetic field generating means excessively increases.

18. An image forming apparatus comprising:

an image forming unit which is configured to form an image on a recording material;

a fixing unit which is configured to heat and fix the formed image on the recording material; and a control unit which is configured to control said image forming unit and said fixing unit, wherein said fixing unit comprises a heating member, a magnetic field generating unit for generating a magnetic field to induce an eddy current in said heating member, and a temperature detecting element for detecting a temperature of said heating member, wherein said control unit controls an electrical supply to said magnetic field generating unit so that the temperature detected by said temperature detecting element is maintained at a target temperature, and said control unit variably sets the target temperature lest a temperature of said magnetic field generating unit excessively increases when said apparatus is at least in a predetermined state.

19. An image forming apparatus according to claim 18, wherein said control unit includes a unit which predicts the temperature of said magnetic field generating unit in accordance with the temperature detected by said temperature detecting element.

20. An image forming apparatus according to claim 18, wherein when said apparatus is in a standby state, said control unit variably sets the target temperature lest the temperature of said magnetic field generating unit excessively increases.

* * * * *

UNITED STATES PATENT AND TRADEMARK OFFICE

CERTIFICATE OF CORRECTION

PATENT NO. : 6,639,195 B2
DATED : October 28, 2003
INVENTOR(S) : Atsuyoshi Abe et al.

It is certified that error appears in the above-identified patent and that said Letters Patent is hereby corrected as shown below:

Title page,
Item [57], ABSTRACT,
Line 9, “a” should read -- at a --;

Column 1,
Line 47, “to” should read -- in order to --.

Column 5,
Line 11, “second,” should read -- second --.
Line 62, “an” should read -- a --.

Column 6,
Lines 44 and 61, “an” should read -- a --.
Lines 45 and 60, “hating” should read -- heating --.

Column 8,
Line 67, “better work.” should read -- work better. --.

Column 9,
Line 1, “perferably” should read -- perferable --.

Column 11,
Line 37, “hating” should read -- heating --.
Line 42, “made” should read -- made to --.

UNITED STATES PATENT AND TRADEMARK OFFICE

CERTIFICATE OF CORRECTION

PATENT NO. : 6,639,195 B2
DATED : October 28, 2003
INVENTOR(S) : Atsuyoshi Abe et al.

It is certified that error appears in the above-identified patent and that said Letters Patent is hereby corrected as shown below:

Column 13,
Line 27, “are” should read -- is --.

Signed and Sealed this

Thirtieth Day of March, 2004

JON W. DUDAS
*Acting Director of the United States Patent and Trademark Office*